US006512333B2

(12) United States Patent
Chen

(10) Patent No.: US 6,512,333 B2
(45) Date of Patent: Jan. 28, 2003

(54) RF-POWERED PLASMA ACCELERATOR/HOMOGENIZER

(76) Inventor: Lee Chen, 1121 Strickland Dr., Austin, TX (US) 78748

( * ) Notice: Subject to any disclaimer, the term of this patent is extended or adjusted under 35 U.S.C. 154(b) by 0 days.

(21) Appl. No.: 10/017,730

(22) Filed: Dec. 14, 2001

(65) Prior Publication Data

US 2002/0113206 A1 Aug. 22, 2002

Related U.S. Application Data

(63) Continuation of application No. 09/315,456, filed on May 20, 1999, now Pat. No. 6,331,701.

(51) Int. Cl.[7] ..... H05H 1/54

(52) U.S. Cl. ..... 315/111.21; 315/111.61; 315/111.71; 315/506; 315/500; 250/251

(58) Field of Search ..... 315/506, 500, 315/111.21, 111.61, 111.71; 250/251

(56) References Cited

U.S. PATENT DOCUMENTS

| | | | | |
|---|---|---|---|---|
| 3,908,183 A | | 9/1975 | Ennis, Jr. | 357/65 |
| 4,120,700 A | | 10/1978 | Morimoto | 148/1.5 |
| 4,361,762 A | | 11/1982 | Douglas | 250/251 |
| 4,612,477 A | | 9/1986 | Dothan | 315/111.21 |
| 4,684,848 A | | 8/1987 | Kaufman et al. | 315/111.81 |
| 5,468,955 A | | 11/1995 | Chen et al. | 250/251 |
| 5,883,470 A | | 3/1999 | Hatakeyama et al. | 315/111.51 |
| 5,896,012 A | * | 4/1999 | Munemasa et al. | 315/111.41 |

* cited by examiner

*Primary Examiner*—Bruce Anderson
*Assistant Examiner*—Nikita Wells
(74) *Attorney, Agent, or Firm*—Booth & Wright, L.L.P.; Matthew J. Booth; Karen S. Wright

(57) ABSTRACT

The RF-powered plasma accelerator/homogenizer produces a quiescent plasma having a generally homogenous preselected plasma potential $V_{PA}$ and a space-charge neutralized plasma beam. The plasma accelerator/homogenizer includes an RF-conductive accelerator/homogenizer structure (17) having a plurality of dielectric-coated accelerator/homogenizer surfaces (619) with total surface area $A_{RF}$ and a containment assembly that includes an RF-grounded structure (112) with a total ground surface area $A_G$, where $A_{RF}>A_G$. The accelerator/homogenizer structure is reactively coupled to an RF source using various approaches for direct or stray capacitive coupling (16). The RF voltage induced on the accelerator/homogenizer surfaces oscillates around a positive offset voltage determined by $(A_{RF}/A_G)^x$, where x is not greater than 4, and causes the surfaces to absorb thermal electrons from the diffusing primary plasma, producing a homogenous quiescent plasma at preselected plasma potential $V_{PA}$, which is approximately equal to the positive value of the offset RF voltage.

11 Claims, 10 Drawing Sheets

RF-POWERED PLASMA ACCELERATOR/HOMOGENIZER

CROSS REFERENCE TO RELATED APPLICATIONS

This application is a continuation of U.S. patent application Ser. No. 09/315,456 filed May 20, 1999 (20.05.1999) is now U.S. Pat. No. 6,331,701.

BACKGROUND OF THE INVENTION

1. Field of the Invention

The present invention relates to the manipulation of plasma characteristics in a particle beam source. More specifically, the present invention provides the capability to produce a generally homogenous, quiescent plasma having a preselected, adjustable plasma potential $V_{PA}$.

2. Description of the Related Art

Devices using beams of particles created from a plasma source have achieved wide utility in many well-known applications, including electronic devices and semiconductor manufacturing processes. However, the inherent instability and nonuniformity of materials in the plasma state have always plagued the performance of typical plasma sources. Even a so-called "quiescent" plasma generally has local nonhomogenous areas throughout its volume, as ions are constantly produced and lost through recombination. The major, inner, portion of a quiescent plasma is substantially space-charge neutralized with the net mutual repulsion between like-charged species balanced by mutual attraction between oppositely charged species. This means, for any charged particle that is well-separated from the boundary of the plasma but having a trajectory toward the boundary of the plasma, a force will be exerted on the plasma which tends to pull it back toward the plasma. Therefore, most of the inner volume of the plasma can be regarded as generally homogeneous.

However, within this population of charged species the electrons are far more mobile than the ions. Therefore, the electrons tend to leave the ions at the boundary of the plasma, creating a slightly greater population of ions near the plasma boundary. In addition, repulsion forces between ions at the plasma boundary tends to accelerate some of the ions outwardly, with such acceleration decreasing with increasing distance from the boundary of the plasma. Simultaneously, as electrons get farther from the ion-rich plasma boundary, their acceleration increases. These conditions are effectively reversed when the boundary of the plasma is near a conductive surface, which tends to return electrons to the plasma and to accelerate ions causing the surface to be negative relative to the plasma and the plasma adjacent to the surface to be positive. This voltage differential is called the plasma potential.

The capability of a plasma to produce accelerated ions has been useful in many applications, including semiconductor manufacturing applications such as Plasma-Enhanced Chemical Vapor Deposition (PECVD), anisotropic Plasma Dry Etching, cleaning, and removal of polymer resist (ashing). In these devices, ions are directed against the surface of a semiconductor structure (e.g. a wafer which may or may not have layers or other structures formed thereon) for purposes of implanting, depositing or etching a material. In addition, the Neutralizer Grid Patent describes etching and cleaning methodologies using a high-energy neutral particle beam created from accelerated ions that pass through a grid and become neutralized by shallow angle elastic surface forward scattering. In either approach, an accelerated ion beam must be extracted from a plasma source by heating the plasma and/or artificially increasing its potential, and then deflected and focused upon the workpiece. However, it is typically more difficult to manipulate an ion beam than an electron beam, since the increased mass of ions (relative to electrons) requires much higher levels of energy. At the same time, precise control of the beam characteristics in an ion beam device is even more important than it is in an electron beam device, since the crystal structure of the semiconductor material is much more easily damaged by the collision of relatively massive ions or neutral particles, even at relatively low velocities, as compared to electrons. Indeed, it is usually necessary to anneal a semiconductor material after an ion implantation operation to restore the crystal lattice structure and repair damage thereto caused by the kinetic energy of the particles used in the implantation process.

Another problem that has plagued typical ion-beam source devices relates to the ability to maintain a coherent ion beam. As described above, it is desirable to keep the overall energy of the accelerated ion beam as low as is necessary to achieve the desired result, to minimize the inevitable damage to the semiconductor's crystal structure that the ion beam will cause. When the ion beam energy is low—on the order of 50 to a few hundred eV—the ion beam must be space-charge neutralized to keep the beam sufficiently coherent to avoid a drastic drop in beam intensity as the beam propagates to the workpiece, and to avoid an undesirable charging effect on the workpiece. This means that a sufficient number of electrons must be introduced into the ion beam, such that the overall charge of the beam in a certain volume of space is neutral. In the absence of these electrons, the repulsion forces between the ions in the beam will cause the beam to quickly diverge and lose intensity.

One method that those in the art have used to introduce electrons into an accelerated ion beam to neutralize the space-charge is to insert an electron source into or near the beam, such as a stand-alone hot filament that emits thermionic electrons. U.S. Pat. No. 4,361,762 to Douglas and the patents referenced therein describe various neutralization techniques and their associated problems that primarily relate to the complexity of the apparatus required and the difficulty of controlling the electron emission rate to achieve space-charge neutralization. Douglas discloses a method and apparatus that uses a closed-loop feedback circuit to control a filament array for space-charge neutralizing an ion beam. While Douglas' apparatus addresses the control difficulty issue, the apparatus still adds undesirable complexity to the plasma source generator to achieve the required beam neutralization The present invention solves the plasma stability problems described above by providing a stable and uniform quiescent plasma that is effectively separated from the primary plasma region. The present invention can produce a high-quality, homogenous quiescent plasma having a user-selected, adjustable artificial plasma potential from any primary plasma, thus obviating the need for a high-quality primary plasma in these types of applications. In addition, the present invention solves the ion beam coherency and neutralization problem because it produces a space-charged neutralized plasma beam that effectively comprises an equal number of accelerated ions and electrons per unit of volume, without the need for additional equipment or control electronics.

SUMMARY OF THE INVENTION

The present invention comprises an RF-powered plasma accelerator/homogenizer that produces a quiescent plasma having a generally homogenous preselected plasma potential $V_{PA}$ from a primary plasma. The plasma accelerator/homogenizer includes an RF-conductive accelerator/homogenizer structure that includes a plurality of dielectric-coated accelerator/homogenizer surfaces having a total surface area $A_{RF}$. The RF-conductive accelerator/homogenizer structure is reactively coupled to an RF source using a coupling device. The RF source produces an RF voltage within the accelerator/homogenizer structure that causes thermal electrons from the primary plasma to be absorbed by the dielectric coated accelerator/homogenizer surfaces that are quasi-uniformly dispersed throughout the primary plasma. The present invention also includes a containment assembly that holds the quiescent plasma at the generally homogenous preselected plasma potential $V_{PA}$. The containment assembly includes an RF-grounded structure having a total ground surface area $A_G$, where $A_{RF}>A_G$. The RF-grounded structure is separated from the accelerator/homogenizer structure by a dielectric material. The coupling device may comprise one or more variable vacuum capacitors, or an RF tuning circuit that incorporates stray capacitance associated with a plasma liquid cooling system coupled to a pick-up electrode adjacent to a dielectric spacer in an arrangement that has a preselected characteristic capacitance, or an impedance-controlled circuit that couples to the RF-conductive accelerator/homogenizer structure using the stray capacitance of the primary plasma, or an RF matching network. The RF voltage produced inside the accelerator/homogenizer structure oscillates around a positive offset voltage determined by $(A_{RF}/A_G)^x$, where x comprises a positive number not greater than 4. The preselected plasma potential $V_{PA}$ is approximately equal to the value of the offset RF voltage when the value of the offset RF voltage is positive.

DESCRIPTION OF THE DRAWINGS

To further aid in understanding the invention, the attached drawings help illustrate specific features of the invention and the following is a brief description of the attached drawings.

DETAILED DESCRIPTION OF THE INVENTION

The present invention is a method and apparatus for an RF-powered plasma accelerator/homogenizer used in a plasma generating device to produce a uniform quiescent plasma having a generally homogenous preselected plasma potential $V_{PA}$ from a primary plasma. The present invention also produces a space-charge neutralized plasma beam. This disclosure describes numerous specific details that include specific structures, circuits, and applications to provide a thorough understanding of the present invention. Those skilled in the art will appreciate that one may practice the present invention without these specific details.

This present invention provides a plasma homogenization and acceleration function when utilized in a plasma source device as described in U.S. patent application Ser. No. 09/315,456 filed May 20, 1999 (20.05.1999), entitled "RF-Grounded Sub-Debye Neutralizer Grid" which is incorporated by reference for all purposes into this specification and referred to hereinafter as the "Neutralizer Grid Patent."

Figure 1:
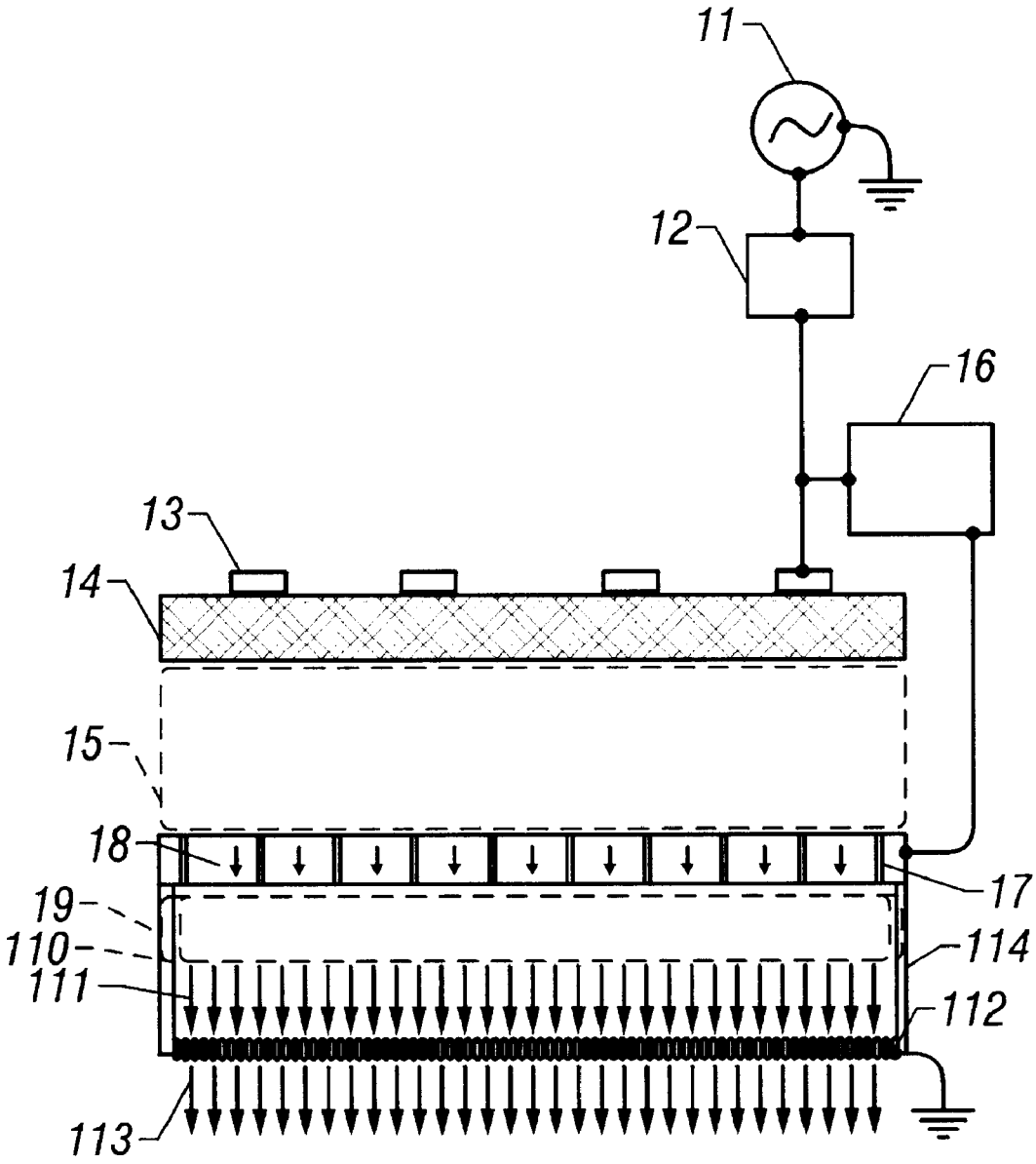
FIG. 1 shows the accelerator/homogenizer apparatus of the present invention in the context of a generic plasma source device.

FIG. 1 shows the accelerator/homogenizer apparatus in the context of a generic plasma source device. The generic plasma source apparatus includes an RF generator 11 which can be a standard 13.56 Mhz generator commonly used in commercial applications, an impedance matching capacitor circuit 12, RF inductor coil 13, RF window 14, a coupling device 16 that reactively couples RF power to the RF-conductive accelerator/homogenizer structure 17, and a containment assembly 114 that includes an RF-grounded structure 112. As described in more detail below, the RF-conductive accelerator/homogenizer structure 17 has a number of electron-absorbing surfaces having a total surface area $A_{RF}$. Likewise, the RF-grounded structure 112 has an active ground surface area $A_G$. The primary plasma region is shown at 15. The primary plasma 15 diffuses through the accelerator/homogenizer structure 17 at 18 to the quiescent plasma region 19. At the quiescent plasma sheath boundary 110, ions begin to accelerate 111 toward the RF grounded structure 112. In FIG. 1, the RF-grounded structure 112 is the sub-debye neutralizer grid described in the Neutralizer Grid patent that produces a hyperthermal neutral beam 113 directed to a workpiece below (not shown in FIG. 1). Alternatively, the RF-grounded structure could be a solid plate, (indeed, the workpiece itself) if the purpose of the apparatus is to simply excite the surface of the RF-grounded structure 112 by the ion beam 111, such as might be appropriate in a device used for wafer washing or cleaning. The primary components of the accelerator/homogenizer apparatus of the present invention include the RF-conductive accelerator/homogenizer structure 17, the coupling device 16, and the containment assembly 114 including the RF-grounded structure 112.

The impedance-matching capacitor circuit 12 is an appropriate arrangement of variable $C_P$ (parallel capacitor) and $C_S$ (series capacitor) for impedance matching of the specific liquid-submerged plasma. Since the present invention controls the characteristics of the quiescent plasma 19, the uniformity of the primary plasma 15 need not be closely controlled, allowing the RF inductor coil 13 to be any convenient configuration.

The accelerator/homogenizer structure 17 is preferably a dielectric-coated metallic material, such as aluminum with an anodized finish or other generally nonconductive coating, that is capable of being reactively coupled to the power source and developing a uniform voltage potential $V_B(t)$. In its simplest form, the coupling device 16 that supplies RF power to the accelerator/homogenizer structure 17 can be a variable vacuum capacitor having total capacitance $C_c$. For a fixed amount of total RF power at the generator output, the value of $C_C$ is directly proportional to the amount of RF power coupled into the accelerator/homogenizer structure 17. Alternatively, the coupling device 16 might comprise an ensemble of variable vacuum capacitors connected in parallel, coupling RF power to the accelerator/homogenizer structure 17 at appropriate spatial locations to maximize the spatial uniformity of the RF power coupled to the structure 17. In other embodiments described below, coupling device 16 may comprise an RF tuning circuit that incorporates stray capacitance caused by a plasma cooling system, an impedance-controlled circuit that couples to the accelerator/homogenizer structure using the stray capacitance of the primary plasma, or an RF matching network.

The coupling device 16 taps power from either the RF inductor coil 13 or a separate RF source (see FIG. 9) to induce RF voltage $V_B(t)$ in the accelerator/homogenizer structure 17, which in turn, charges the plasma to the preselected artificial plasma potential $V_{PA}$. The high-frequency conductivity of the metallic accelerator/homogenizer structure is orders of magnitude higher than that of the primary plasma, so that the surfaces of the accelerator/homogenizer structure in contact with the primary plasma absorb electrons, leading to the buildup of voltage potential within the plasma. When the accelerator/homogenizer structure includes a plurality of dielectric coated accelerator/homogenizer surfaces that are quasi-uniformly dispersed throughout the primary plasma's diffusion area, electrons are absorbed uniformly throughout the volume of the plasma as it diffuses through the structure, equalizing local potential nonuniformity caused by the natural potential of the plasma.

Therefore, the accelerator/homogenizer apparatus of the present invention performs two primary functions: it charges the quiescent plasma to the preselected artificial plasma potential $V_{PA}$, and it homogenizes the charged plasma to minimize localized inconsistencies. The magnitude of $V_{PA}$ is largely determined by two factors: the amount of RF power coupled to and developed within the metallic accelerator/homogenizer structure, and the positive voltage bias produced by the ratio of the total accelerator/homogenizer surface area $A_{RF}$ to the total surface area of the RF-grounded structure $A_G$.

Figure 2:
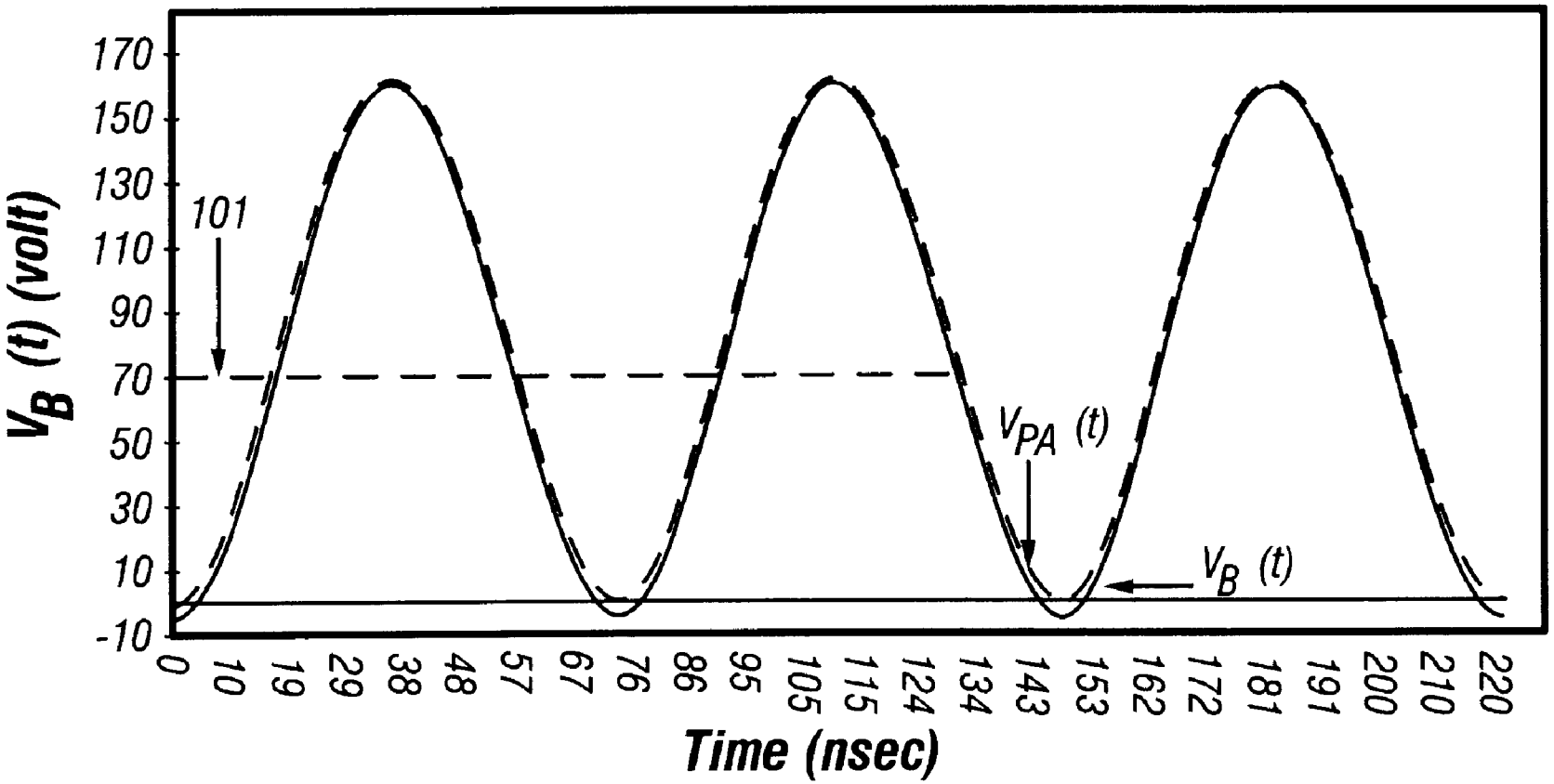
FIG. 2 shows the relationship between $V_B(t)$, $V_{PA}(t)$, and the positive bias produced by the ratio $A_{RF}/A_G$.

FIG. 2 shows the relationships between the RF voltage induced in the accelerator/homogenizer structure $V_B(t)$, the corresponding artificial plasma potential developed by the quiescent plasma $V_{PA}(t)$, and the positive bias 101 produced by the area ratio of the accelerator/homogenizer surfaces to the ground surface in a typical accelerator/homogenizer apparatus. In FIG. 2, $V_B(t)$ is the solid curve that is oscillating around the forward bias 101, which is approximately 70 Volts in this example. Note that at its lower peak, $V_B(t)$ may go negative. In a typical accelerator/homogenizer arrangement, $V_{PA}(t)$ closely follows $V_B(t)$, except that due to the natural plasma potential at the plasma sheath, $V_{PA}(t)$ never goes negative.

The value of the voltage offset is governed by the following relationship:

$$\left|\frac{V_+}{V_-}\right| = \left(\frac{A_{RF}}{A_G}\right)^X$$

where X is theoretically 4. However, X varies due to plasma parameters, discharge vessel conditions, and the spatial density of $A_{RF}$ in relation to the plasma; a typical experimental value for X is approximately 2.5. $V_+$ and $V_-$ are the positive peak and the negative peak of $V_B(t)$ respectively (sometimes termed $V_B+$ and $V_B-$). At a given amount of RF power coupled into the accelerator/homogenizer assembly, a properly chosen $A_{RF}/A_G$, where $A_{RF}$ has an appropriate spatial density, will yield a desired $V_B(t)$ offset. Since, as shown in FIG. 2, $V_{PA}(t)$ closely follows $V_B(t)$, from 0 up to V+, tuning the size and position of the electron-absorbing accelerator/homogenizer surfaces to achieve a preselected $V_B(t)$ offset allows practitioners of the present invention to achieve a preselected adjustable plasma potential that is far above the natural plasma potential.

During the time that $V_B(t)$ is positive during the majority of each RF period, ions are extracted and accelerated out of the plasma towards the RF-grounded structure. During the few nanoseconds that $V_B(t)$ goes negative, electrons are pushed out of the system towards the RF-ground. The capacitive coupling mechanism used by the present invention causes the number of electrons that accelerate and leave the system during the negative portion of the $V_B(t)$ cycle to equal the number of ions extracted during the much longer positive portion of the $V_B(t)$ cycle. In another words, over each RF-period, the same number of positive ions and electrons leave the system. Consequently, the accelerated particle beam produced by the present invention contains accelerated ions, but also a sufficient number of electrons to render the beam inherently space-charge neutralized, thus eliminating any necessity for additional equipment and electronics to neutralize the beam or workpiece. The present invention thus inherently provides a coherent plasma beam that does not build up undesirable charge on the target workpiece.

Figure 3:
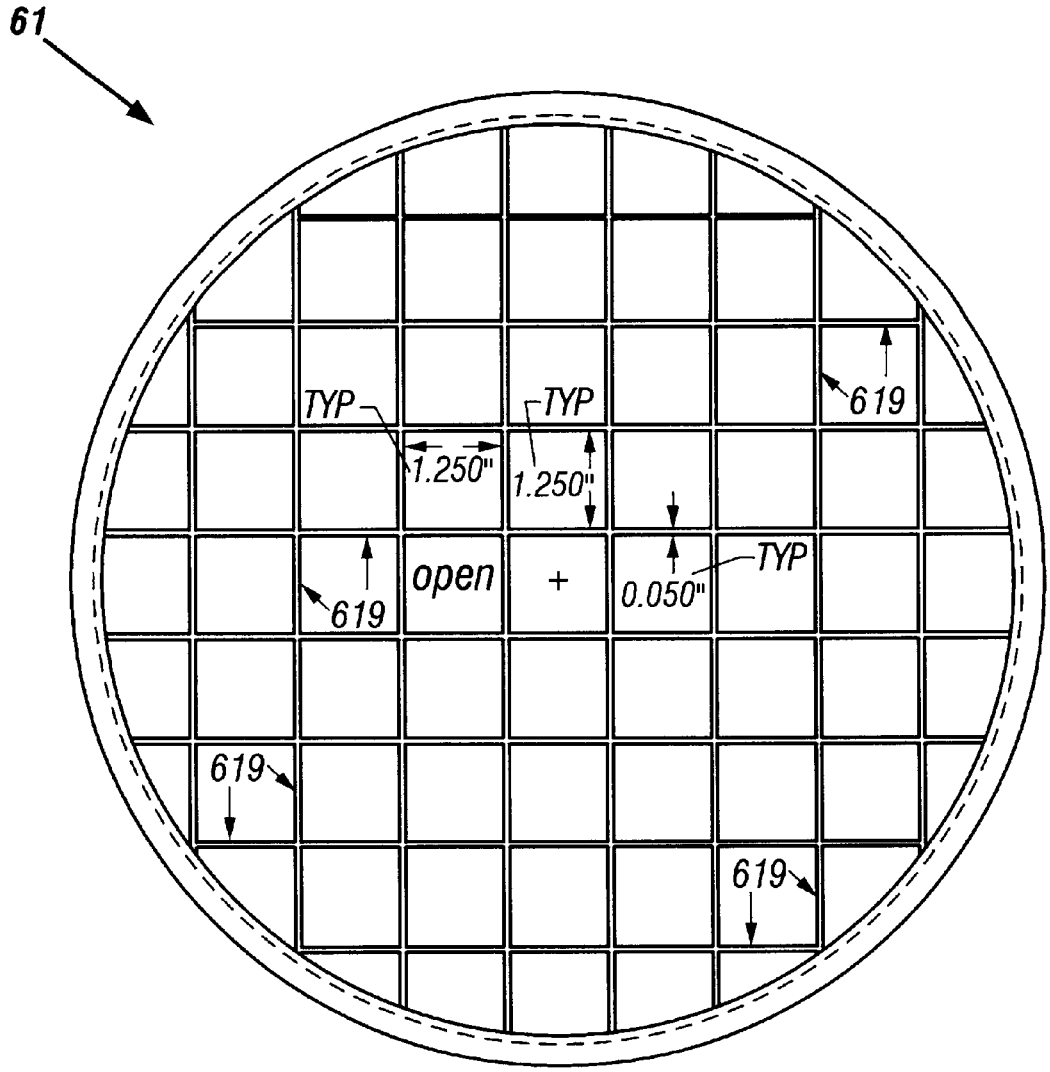
FIG. 3 shows one embodiment of a RF-conductive accelerator/homogenizer structure that includes a plurality of electron-absorbing surfaces in a grid arrangement.

FIG. 3 shows one embodiment of a RF-conductive accelerator/homogenizer structure 61 that includes a plurality of electron-absorbing surfaces 619 in a grid arrangement. The primary plasma diffuses through the accelerator/homogenizer structure 61 in a direction normal to the accelerator/homogenizer structure 61 and parallel to the electron-absorbing surfaces 619. As described above, both the artificial plasma potential and the density uniformity of the quiescent plasma produced below the accelerator/homogenizer structure 61 are affected by the spatial surface area density of the structure. Therefore, the grid arrangement shown in FIG. 3 allows for a uniform dispersal of the electron-absorbing surfaces 619, producing a quiescent plasma having a generally homogeneous $V_{PA}$. In addition, the overall thickness of the accelerator/homogenizer structure can be adjusted to increase or decrease the total surface area $A_{RF}$ of the electron-absorbing surfaces 619, thereby increasing or decreasing the $V_B(t)$ offset, and correspondingly, $V_{PA}$.

Those skilled in the art will recognize that practitioners of the present invention can fine-tune the accelerator/homogenizer structure to adjust plasma properties (e.g., further smooth out the plasma to eliminate any possible residue ripple caused by localized variable $n_e$, or $T_e$) by tailoring the accelerator/homogenizer structure. For example, the first-pass prototype with a uniform height accelerator/homogenizer structure produced an azimuthally uniform quiescent plasma, but having a radial nonuniformity wherein the center intensity was approximately 10% higher than the edge intensity. Introducing a 10% gradient on the accelerator/homogenizer structure thickness, where the center was thicker than the edges, caused the radial nonuniformity of the quiescent plasma to range between ±5%. As this example illustrates, the accelerator/homogenizer structure can include a spatial gradient in its "surface-area volume density" which provides additional surface area for electron absorption. Such a configuration might be appropriate in a plasma source apparatus where the plasma has localities where $n_e$ is consistently higher. Tailoring the accelerator/homogenizer structure as described herein thus provides a secondary channel for plasma homogenization.

Figure 4:
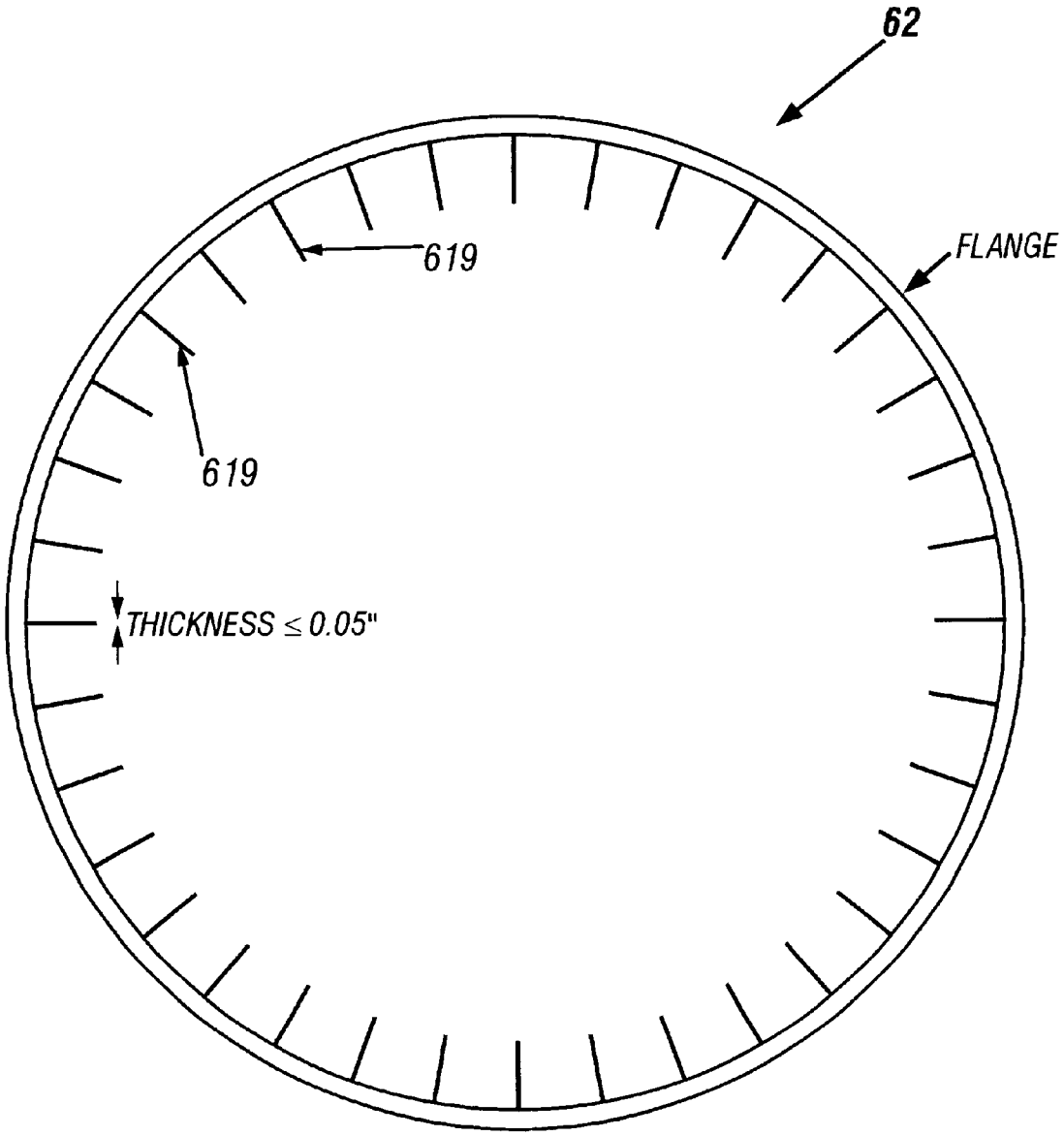
FIG. 4 show another embodiment of an accelerator/homogenizer structure that includes a number of fins arranged around the periphery of the structure.

FIG. 4 shows another embodiment of an accelerator/homogenizer structure 62 that includes a number of fins arranged around the periphery of the structure 62. Each side of each fin comprises an electron-absorbing surface 619 that interacts with the primary plasma as it diffuses through the structure 62 in a direction normal to the structure 62 and parallel with the electron-absorbing surfaces 619. However, unlike the grid structure 61 shown in FIG. 3, the electron-absorbing surfaces 619 of the accelerator/homogenizer structure 62 shown in FIG. 3 are not uniformly dispersed throughout the plasma diffusion area. The interaction between the surfaces of the accelerator/homogenizer structure and plasma electrons is critical in order to homogenize the plasma and to control $V_{PA}(t)$ of the plasma. In FIG. 4, even if the electron-absorbing surfaces 619 have the same total surface area $A_{RF}$ as the FIG. 3 structure (and thus the same $A_{RF}/A_G$ ratio), a sufficient voltage offset would not develop because the electron-absorbing surfaces 619 are not generally in the path of the primary plasma's thermal electrons as they diffuse through the structure. As this example demonstrates, a properly designed accelerator/homogenizer apparatus must include both a sufficient area of electron-absorbing surfaces and a sufficient area density to allow sufficient interaction with the diffusing thermal electrons.

Finally, while it is important that the electron-absorbing surfaces 619 of the accelerator/homogenizer structure be dispersed throughout the plasma diffusion area in order to provide sufficient interaction with the plasma's thermal electrons, the surfaces must be oriented to avoid interfering with the plasma's high-energy ballistic electrons. In both FIGS. 3 and 4, the electron-absorbing surfaces are configured to be parallel with the plasma diffusion direction. This configuration insures that the electron-absorbing surfaces can intercept and interact with the thermal electrons as the primary plasma diffuses through the structure, while not interfering with the energetic ballistic electrons moving in the same direction, normal to the quiescent plasma region toward the plasma sheath near the RF-ground structure.

Plasma beam flux is proportional to the quiescent plasma $n_e$. It is also proportional to the ion drift velocity, $u_0$, which is the velocity of ions injected across the pre-sheath, which is theoretically defined by the relationship $$u_0>(kT_e/M)^{1/2}$$

where M is the mass of the ion and k is the Boltzmann constant. In this expression, $T_e$ is always considered to be isotropic. In reality, $T_e$ is not purely isotropic, but rather, can have a significant translation component (the anisotropic component). Nevertheless, the higher the ion drift velocity $u_0$, the higher the plasma beam flux, and the more efficiently the entire system will operate. Thermal electrons generally have a low $T_e$, and consequently, do not contribute much to the overall ion drift velocity. But ballistic electrons are high-energy electrons with a large anisotropic $T_e$ Ballistic electrons are produced in the heated primary plasma region. The most efficient systems will take advantage of the higher ion drift velocity produced by high-energy ballistic electrons to boost the plasma beam flux created by the quiescent plasma. Therefore, the electron-absorbing surfaces of the accelerator/homogenizer structure are configured to interact with and absorb thermal electrons, while allowing ballistic electrons to pass through undisturbed.

Figure 5:
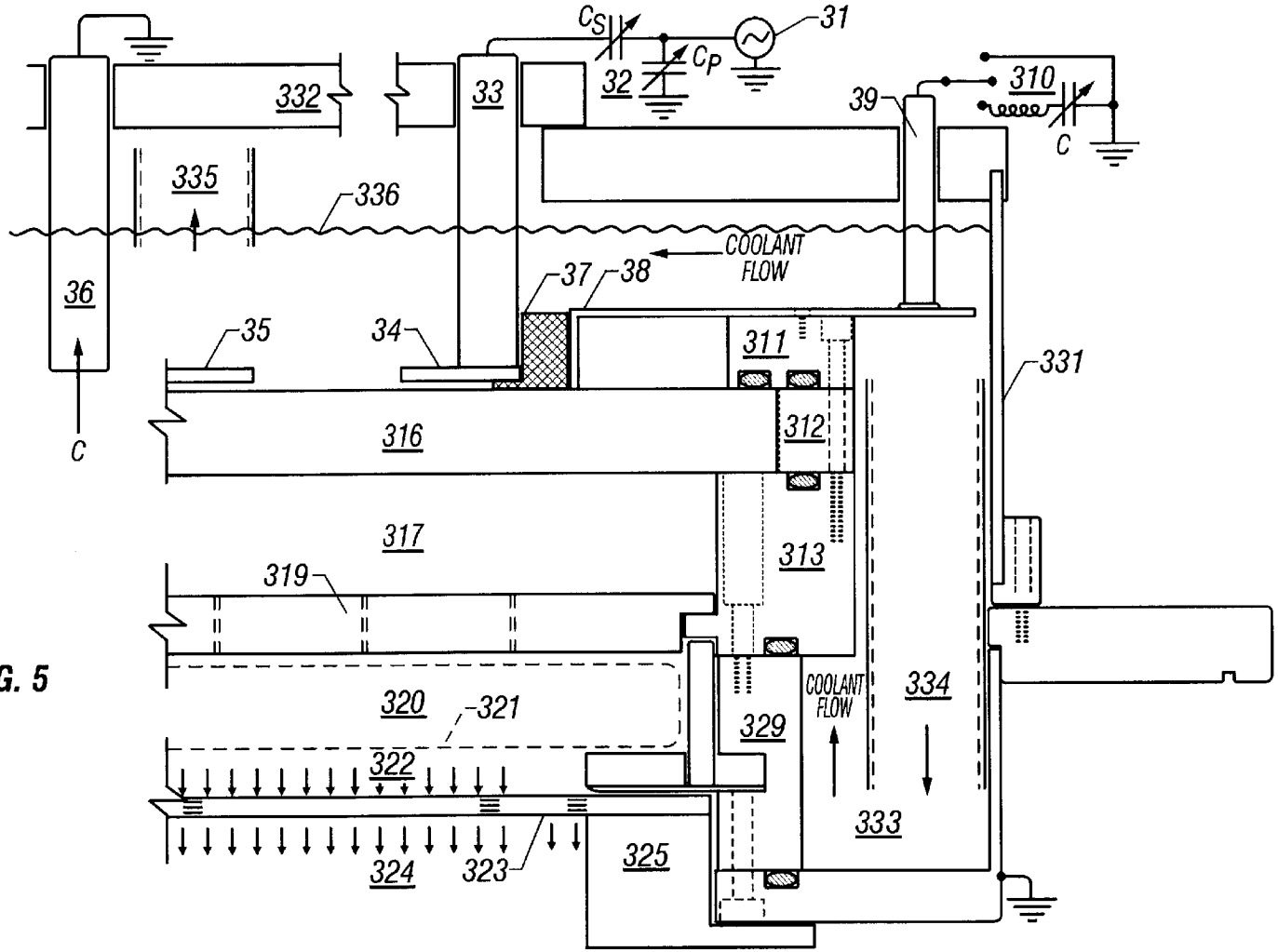
FIG. 5 shows an embodiment of the present invention in an exemplary inductively-heated liquid-cooled plasma source generator wherein the coupling device includes an RF tuning circuit that incorporates the stray capacitance of the cooling system.
Figure 8:
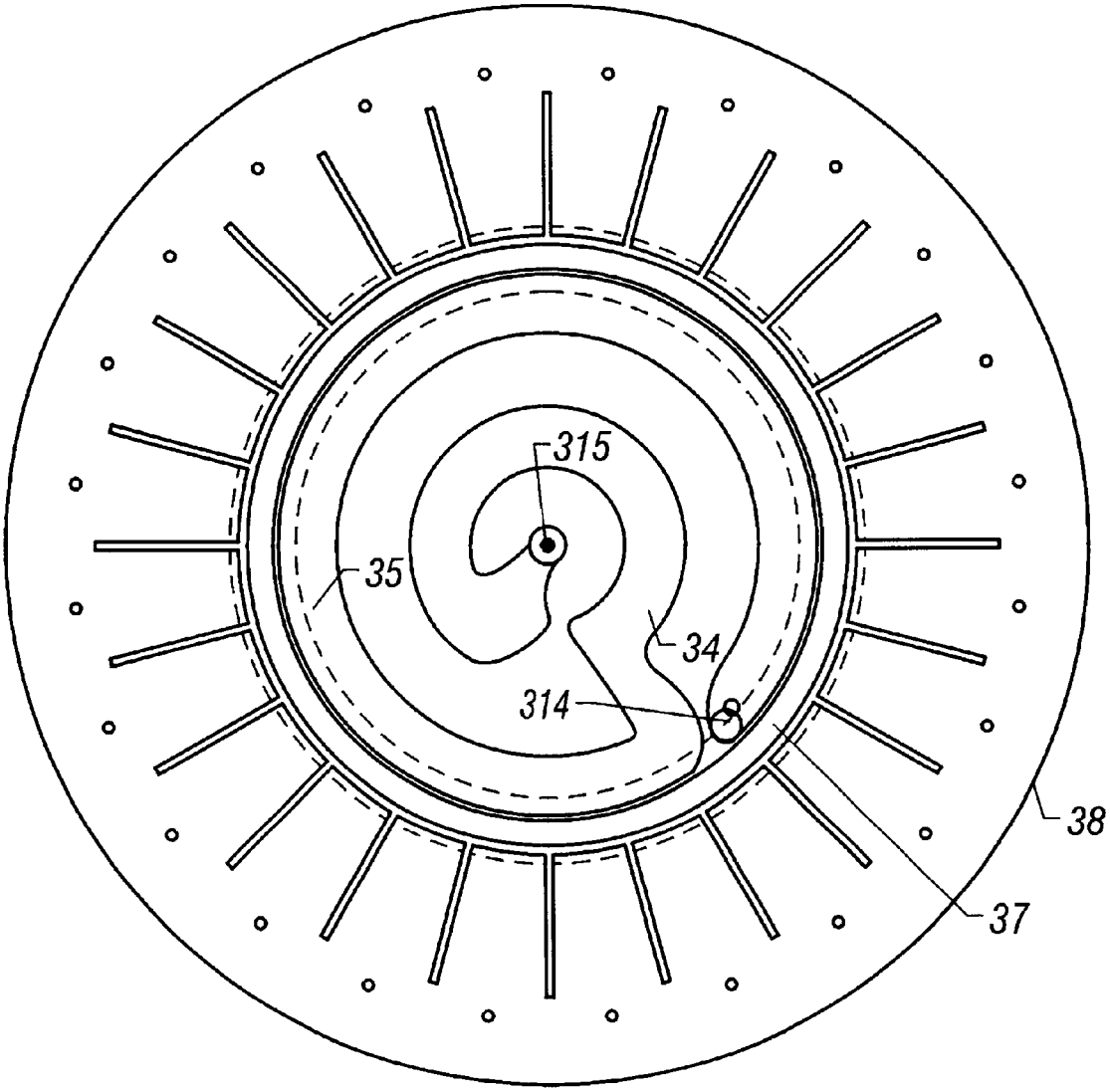
FIG. 8 is a top view showing the relative arrangement of a flat RF coil, a ring-shaped dielectric spacer, and an immediately adjacent circular pick-up electrode.

FIG. 5 shows an embodiment of the present invention in an exemplary inductively-heated liquid-cooled plasma source generator wherein the coupling device (16 in FIG. 1) incorporates an RF tuning circuit that incorporates the stray capacitance of the cooling system. The FIG. 5 liquid-cooled system includes an RF generator 31, the impedance matching $C_P/C_S$ capacitor circuit 32, RF power connection rods 33 and 36 that provide power to the flat 2-turn RF coil 34 and 35, a ring-shaped dielectric spacer 37 that separates the RF coil from a circular pick-up electrode 38 that encircles the RF coil. A top view showing the arrangement of the flat RF coil having an inner turn 34 and an outer turn 35, ring-shaped dielectric spacer 37, and immediately adjacent circular pick-up electrode 38 is shown in FIG. 8. In FIG. 8, the RF input is shown at 314 and the RF ground return is at 315.

Together, the spacer 37 and the adjacent pick-up electrode 38 capacitively couple RF power from the coil 34, 35 to the accelerator/homogenizer structure 313 and its electron-absorbing surfaces 319. Together, 37 and 38 form a preset "stray" system capacitance $C_C$ having a capacitance value that takes into account other stray system values as described in more detail below. In the embodiment shown in FIG. 8, the RF coil, dielectric spacer, and pick-up electrode are symmetrically arranged, such that the inner circumference of the pick-up electrode is equidistant from the outer edge of the RF coil at every point along the outer turn of the RF coil. However, the coil, spacer, and pick-up electrode could be designed such that there is a decreasing separation distance between the pick-up electrode and the outer turn of the RF coil, to compensate for the continuous decrease of RF voltage around the coil from the highest level at the RF input point 314 to the lowest level at the RF ground return point at 315. In this arrangement, the coil, spacer, and electrode would still be flat, but the inner circumference of the electrode and the outer circumference of the dielectric spacer would no longer be perfectly circular. In yet another embodiment, the coil, spacer, and electrode could form a three-dimensional spiral, wherein the dielectric space separating the coil and the electrode decreases along the entire length of the coil (both turns), to compensate for the continuous decrease of RF voltage along the entire length of the coil. The maximum separation distance between the pick-up electrode and the outer edge of the RF coil would be at the RF input point 314. The separation distance would gradually decrease in a counterclockwise direction, following the coil outer edge, to a minimum separation distance at 315. As a result, the coupling capacitance value $C_C$ would vary azimuthally along the pick-up electrode, so that the amount of RF power coupled from the inductive RF coil to the pick-up electrode is a constant at every point along the pick-up electrode, allowing for a perfect, azimuthally uniform RF coupling into the accelerator/homogenizer structure.

Returning to FIG. 5, and the flat coil/electrode arrangement, the exemplary plasma source generator includes a gas manifold 311 that clamps the RF window 316, spacer 312, plasma containment assembly that includes the RF-grounded structure 323 and a dielectric spacer 329 that separates the RF-grounded structure 323 from the accelerator/homogenizer structure 313, and heat sink 325 that cools the RF-grounded structure 323.

The plasma cooling fluid 333 is supplied through an entry tube 334. The fluid 333 flows around the plasma source generator and is returned though vacuum return tube 335. Reference 336 is the coolant fluid level. The coolant fluid is retained by a dielectric coolant bucket 331 and covered with a lid 332.

The pick-up electrode 38 is coupled to a switch 310 via a copper rod 39. When switch 310 is connected to ground, the RF voltage in the pick-up electrode is coupled to ground, thus cutting RF power to the accelerator/homogenizer structure 313, 319. The drain circuit of switch 310 is usually set at minimum C such that there is no power drain when the switch is on and the pick-up electrode is providing power to the accelerator/homogenizer structure 313, 319. When the switch 310 is on and power is supplied to the RF coil 34, 35 and the accelerator/homogenizer structure 313, 319, the primary plasma 317 diffuses into the quiescent plasma region 320. Quiescent plasma 320 has a plasma sheath boundary 321 from which the plasma is accelerated by the $V_{PA}(t) \sim V_B(t)$ into the accelerated plasma beam 322. In this example, the RF-grounded structure 323 comprises an RF-grounded sub-Debye neutralizer grid as described in the Neutralizer Grid patent. Accordingly, the hyperthermal neutral beam produced by the sub-Debye neutralizer grid is shown at 324.

Figure 6A:
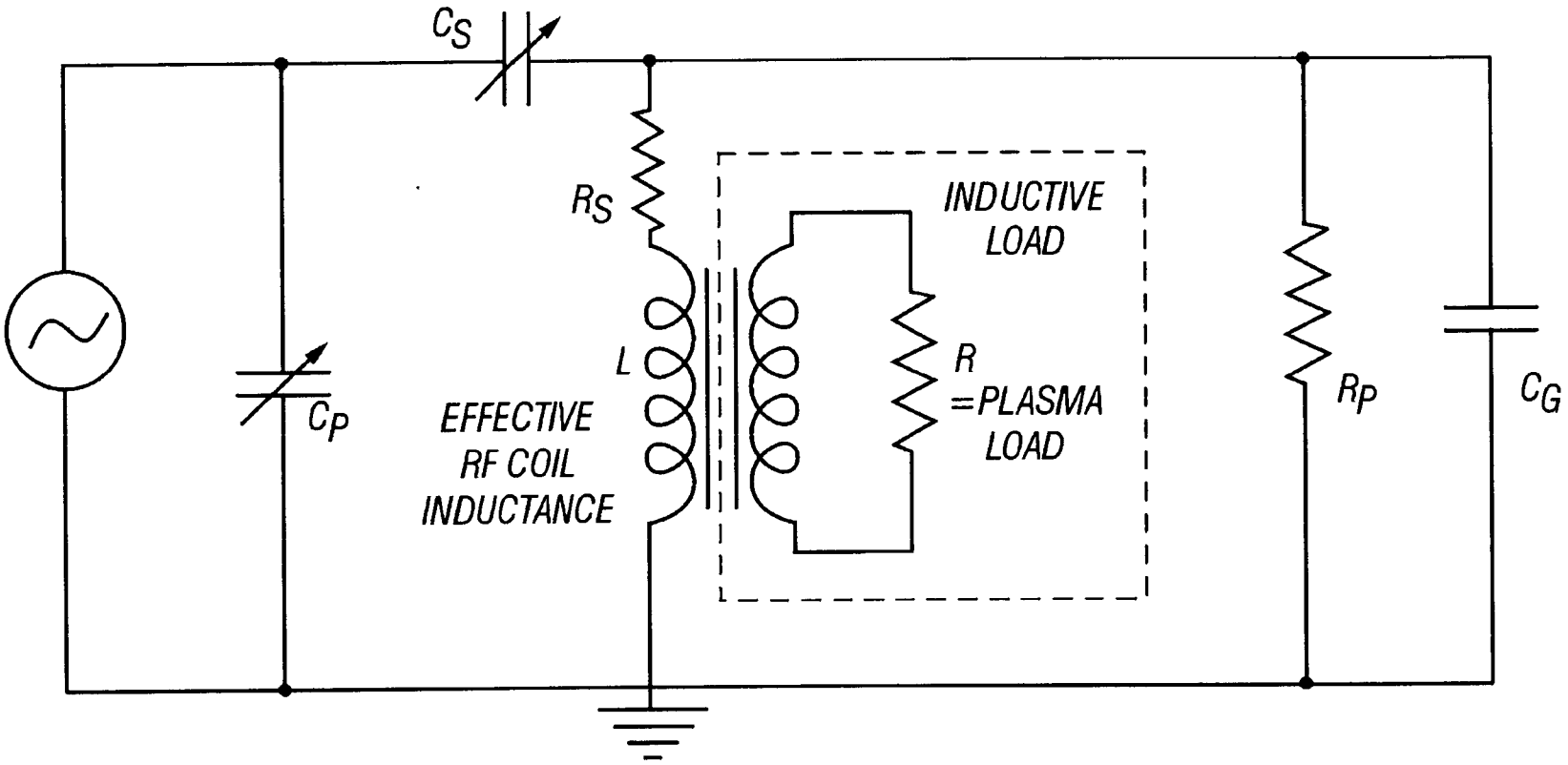
FIG. 6A shows a generic RF tuning circuit appropriate for use in a low-κ liquid-cooled plasma source system.

FIG. 6A shows a generic RF tuning circuit that incorporates the stray components of the liquid-cooled plasma source system shown in FIG. 5. This circuit comprises a generic schematic representation of the stray elements that must be considered when configuring the capacitive coupling device (in this example, the spacer 37 and pick-up electrode 38) to have a specific capacitance value $C_C$. In this circuit, the coolant fluid is one having a relatively low RF dielectric constant, such as purified mechanical pump oil ($\kappa$=2.4). In FIG. 6A, $C_P$ and $C_S$ are the variable capacitors described above in connection with FIG. 1 (impedance matching capacitor circuit 12). $R_S$ is the skin resistance of the RF coil, $R_P$ is the parallel resistance of the coolant, and $C_G$ is the stray capacitance of the coolant, which is largely determined by the dielectric constant $\kappa$ of the coolant. In a physically large system that uses a low-$\kappa$ coolant, it is essential that $C_G$ be minimized, and $R_P$ be controlled, to insure that current is not diverted from the RF coil, resulting in inefficient plasma heating.

Figure 6B:
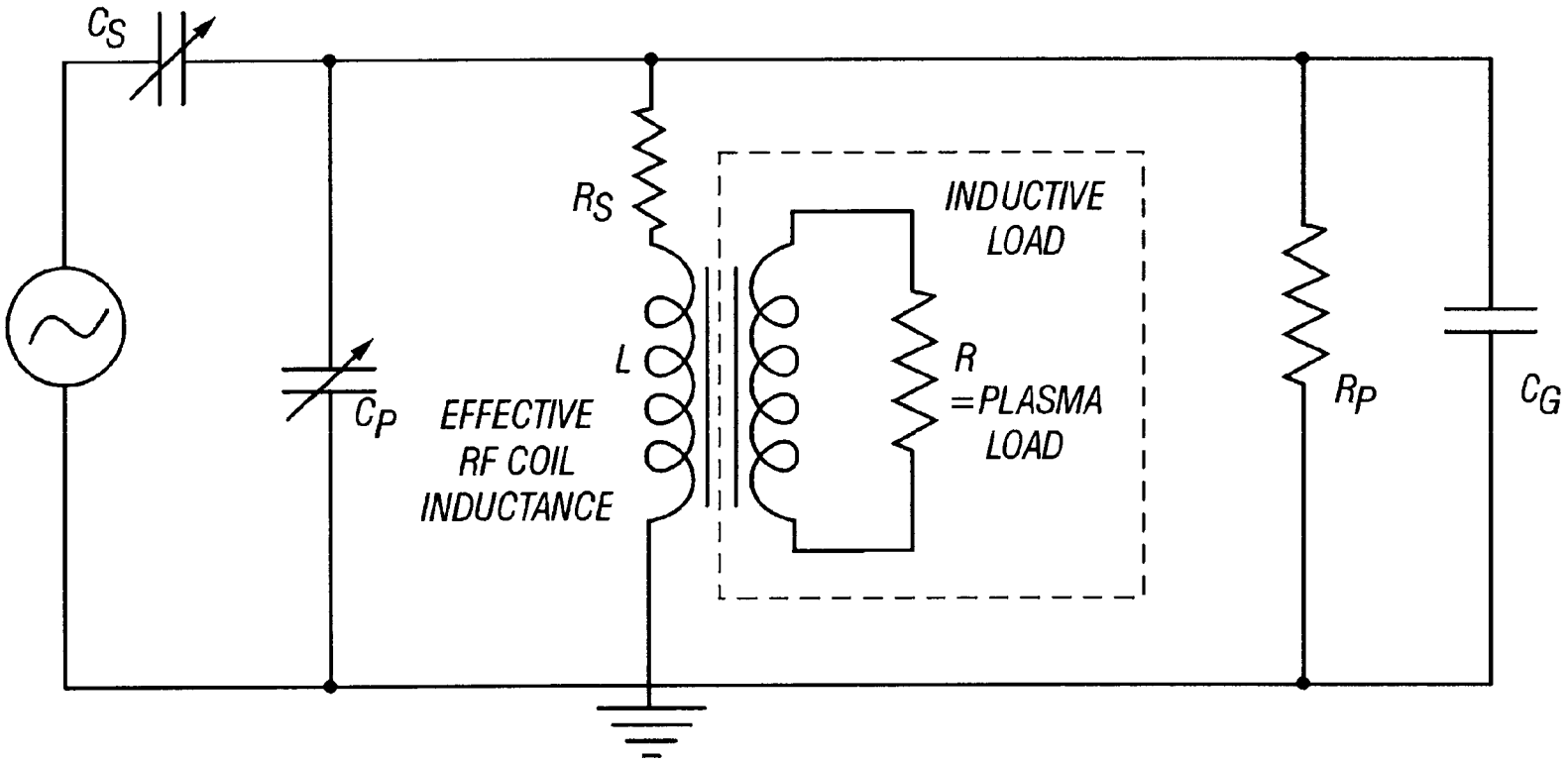
FIG. 6B shows a generic RF tuning circuit appropriate for use in a high-κ liquid-cooled plasma source system.

FIG. 6B shows a generic RF tuning circuit that incorporates the stray components of the liquid-cooled plasma source system shown in FIG. 5, when the coolant fluid is one having a relatively high RF dielectric constant, such as pure water ($\kappa$=80). In this case, $C_G$ is large. Consequently, $C_P$ is placed directly in parallel with the RF coil to insure that the coil heating is efficient.

Figure 7:
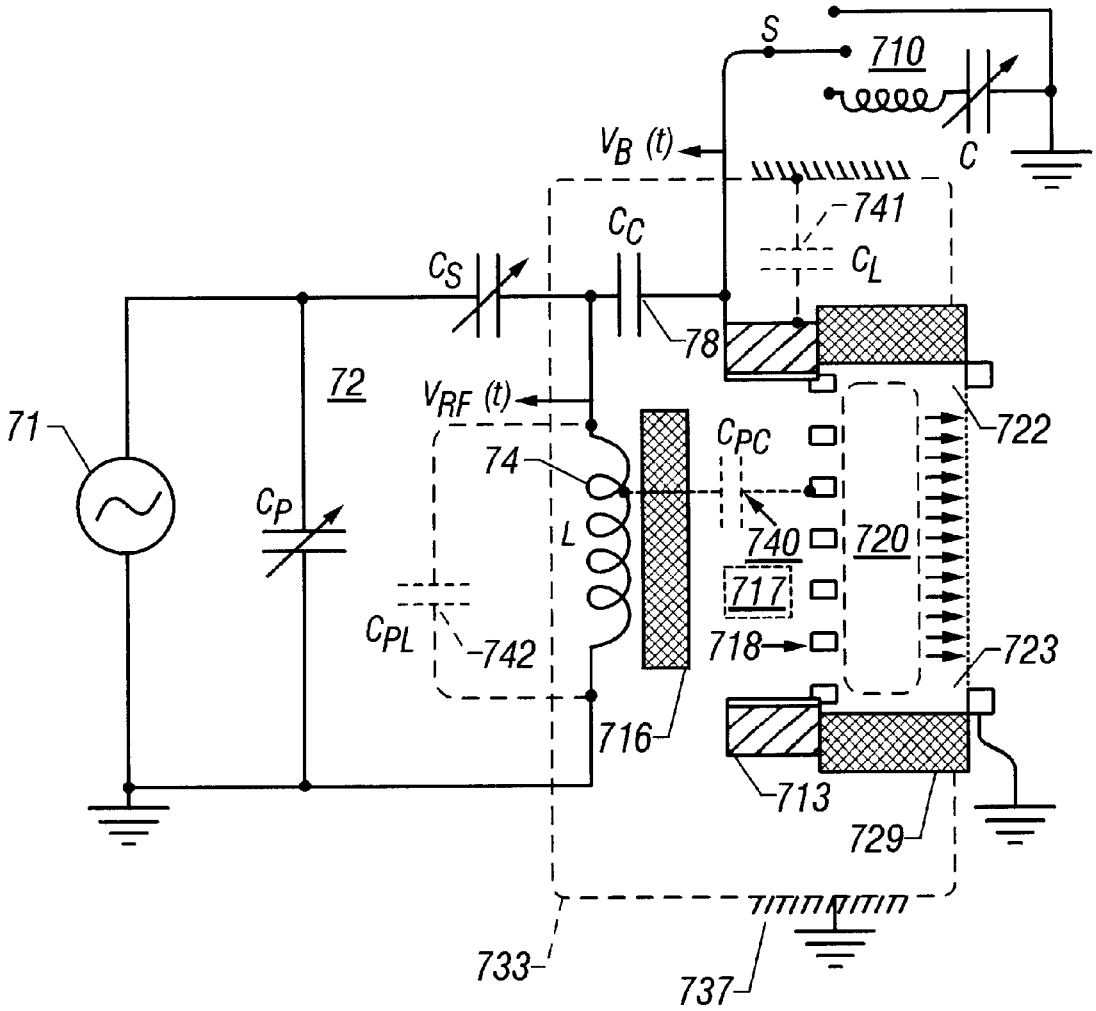
FIG. 7 is a schematic that shows the use of the low-κ RF tuning circuit and the resulting capacitive coupling configuration in a low-κ liquid-cooled plasma source system.

FIG. 7 is a schematic that shows the use of the low-$\kappa$ RF tuning circuit and the resulting capacitive coupling configuration in the context of a system such as that shown in FIG. 5.

FIG. 7 shows the RF generator 71, the L-type $C_P/C_S$ network 72 described in FIG. 6A, the RF coil 74 having an effective inductance denoted by L, and stray capacitance elements $C_{PC}$ 740, $C_L$ 741, and $C_{PL}$ 742. The use of an oil coolant ($\kappa$~2) instead of water coolant ($\kappa$~80) makes the tank capacitance of the coolant $C_{PL}$ 742 small, enabling the use of the L type $C_P/C_S$ network 72. If water is used as the coolant, a Tr type $C_P/C_S$ network such as the one shown in FIG. 6B would be used. $C_L$ 741 is the coolant capacitance coupling the accelerator/homogenizer structure 713 to the grounded plasma source enclosure 737. $C_{PC}$ 740 is the stray capacitance coupling the RF coil 74 to the RF accelerator/homogenizer structure 718 and 713 through the primary plasma 717. In this embodiment, CPC is generally not sufficient for the powering of the large size accelerator. Therefore, $C_C$ (78) provides the primary mechanism to capacitively couple the RF power to the accelerator/homogenizer structure. As described above in connection with FIGS. 5 and 6A, $C_C$ is the tuned capacitance of the dielectric spacer 37 and pickup-electrode 38 shown in FIG. 5.

For completeness, FIG. 7 shows the coolant fluid boundary 733, the RF window 716, and the containment assembly comprising the RF-grounded structure 723 and a dielectric spacer 729 that separates the RF-grounded structure 723 from the accelerator/homogenizer structure 713, 718. The dielectric spacer is sized to minimize CL 741, thus avoiding power leakage from the accelerator/homogenizer structure 718, 713 through the coolant to the grounded plasma source enclosure. The quiescent plasma is shown at 720, and the plasma flux created by the acceleration of particles from the quiescent plasma sheath to the RF-grounded structure 723 is denoted by the arrows at 722. FIG. 7 also shows the switch 710 that dumps the RF power to the accelerator/homogenizer structure 713, 718, to ground allowing the plasma beam to be turned off.

In each of the embodiments described above, RF power is directly coupled from the inductor coil to the accelerator/homogenizer structure using a reactive coupling device having capacitance value $C_C$. In some cases, $C_C$ is one or more variable vacuum capacitors. In others, $C_C$ is an induced capacitance generated by the physical configuration and arrangement of a pick-up electrode in close proximity to the RF coil. The $C_C$-coupled mode is a direct diversion of a portion of the input RF power from the RF coil to the accelerator/homogenizer structure that is simple and effective in driving up $V_B(t)$ to a very high value. However, in some cases, a lower $V_B(t)$, less than 50 V, might be desirable. When a lower $V_B(t)$, is the objective, RF power can be coupled to the accelerator/homogenizer structure directly through the plasma. This is referred to herein as the "plasma-coupled mode."

In the $C_C$-coupled mode, the value of $C_C$ is non-zero. If the LC leg is tuned to have a very low impedance at the frequency of the RF source, then a very large portion of the input RF power will be diverted towards the accelerator/homogenizer coupling circuit via $C_C$ and $V_B(t)$ will build up very high, potentially on the order of thousands of volts. On the other hand, if a lower $V_B(t)$ is the objective, LC can be tuned to have a high impedance value at the RF source frequency, causing a greater amount of the source RF power to pass through the RF coil and a lesser amount to be coupled to the accelerator/homogenizer structure. In the plasma-coupled mode, LC is tuned to have a high impedance and the hardware is engineered such that $C_C$ approaches zero. The primary capacitive coupling between the RF coil and the accelerator/homogenizer structure is through $C_{PC}$, the capacitive coupling from the RF coil through the RF window to the plasma and to the accelerator/homogenizer structure. The input RF power travels through the plasma before it reaches the accelerator/homogenizer structure.

In the plasma-coupled mode, as described above, the magnitude of $V_B(t)$ depends on the impedance value at the RF source frequency, which is controlled by the LC setting. The maximum $V_B(t)$ build-up occurs at the maximum impedance level that the LC circuit can provide. As the LC is tuned such that the impedance approaches zero, the $V_B(t)$ build-up decreases towards 0. When $V_B(t)$ is approximately zero, the accelerator/homogenizer structure can be externally biased to the desired level using either a DC bias or another RF power source at a different frequency, or a DC bias. Even though the LC is tuned to nearly zero impedance, the heating of the primary plasma is not significantly altered, because the input RF power travels through the plasma before reaching the accelerator circuit.

Figure 9:
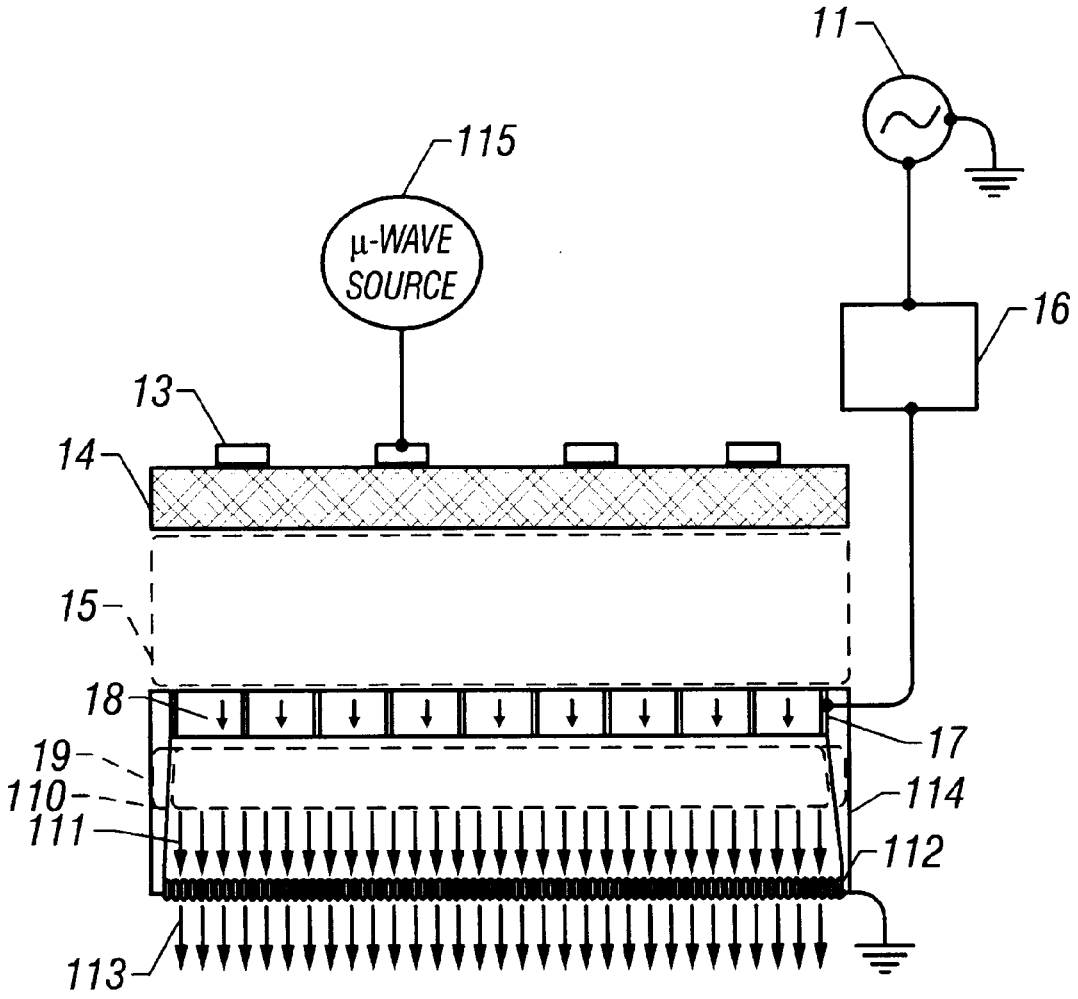
FIG. 9 shows another embodiment of the present invention that uses a capacitive RF matching network to couple power from an RF source used solely for accelerator/homogenizer structure power.

FIG. 9 shows another embodiment of the present invention, wherein the RF coupling device 16 comprises a capacitive RF matching network that couples RF power from an RF source 11 that is used solely for powering the accelerator/homogenizer structure 17. The primary plasma 15 is heated by a separate power source 115. Power source 115 could be another RF power source providing, for example, RF induction heating or RF Helicon wave heating. Alternatively, power source 115 could be a microwave source providing, for example, Electron Cyclotron Resonance heating, or Surface Wave heating. The choice of the primary plasma's power source and heating method will depend on the user-desired plasma characteristics. For example, if the object is to maximize the plasma beam flux extracted, the FIG. 9 configuration might be desirable, wherein the primary plasma is heated by a dedicated power source, using a heating method that maximizes the flux of the ballistic electrons crossing the quiescent plasma sheath towards the RF-ground structure. As discussed above in connection with the description of the accelerator/homogenizer structure and its electron-absorbing surfaces, an enhanced ballistic (directional) electron current crossing the quiescent plasma sheath (specifically, its "pre-sheath") would enhance the ion drift velocity ($u_0$) into the pre-sheath, allowing an enhanced ion current to be extracted from the sheath.

For example, in FIG. 9, the power source 115 might be a microwave power source with TM (transverse magnetic) mode coupling to the plasma. The primary plasma 15 could be a surface wave heated plasma. The TM-coupling mode provides an electric field perpendicular to the radiation window 14 (i.e., towards the accelerator/homogenizer structure 17 and the RF-ground structure 112) that produces accelerated electrons normal to the quiescent plasma sheath. At microwave frequency, these accelerated electrons are "collisionless" across the plasma body, thus preserving their acquired energy and becoming ballistic. As described above, if the electron-absorbing surfaces of the accelerator/homogenizer structure 17 are properly configured for maximum efficiency (such as the embodiment shown in FIG. 3), these ballistic electrons will pass through the accelerator/homogenizer structure 17 unimpeded.

Returning to FIG. 9, the type of RF matching network depends upon the load impedance range, but it can be as simple as an L network. In this embodiment, the amount of power coupled to the accelerator/homogenizer structure is driven by the RF output power of the RF source 11.

In sum, the present invention is an RF-powered plasma accelerator/homogenizer that produces a quiescent plasma having a generally homogenous preselected plasma potential $V_{PA}$ from a primary plasma, along with a space-charge neutralized plasma beam. The plasma accelerator/homogenizer includes an RF-conductive accelerator/homogenizer structure that includes a plurality of dielectric-coated accelerator/homogenizer surfaces having a total surface area $A_{RF}$. The RF-conductive accelerator/homogenizer structure is reactively coupled to an RF source using a coupling device. The RF source produces an RF voltage within the accelerator/homogenizer structure that causes thermal electrons from the primary plasma to be absorbed by the dielectric coated accelerator/homogenizer surfaces that are quasi-uniformly dispersed throughout the primary plasma. The present invention also includes a containment assembly that holds the quiescent plasma at the generally homogenous preselected plasma potential $V_{PA}$. The containment assembly includes an RF-grounded structure having a total ground surface area $A_G$, where $A_{RF}>A_G$. The RF-grounded structure is separated from the accelerator/homogenizer structure by a dielectric material. The coupling device may comprise one or more variable vacuum capacitors, or an RF tuning circuit that incorporates stray capacitance associated with a plasma liquid cooling system coupled to a pick-up electrode adjacent to a dielectric spacer in an arrangement that has a preselected characteristic capacitance, or an impedance-controlled circuit that couples to the RF-conductive accelerator/homogenizer structure using the stray capacitance of the primary plasma, or an RF matching network. The RF voltage produced inside the accelerator/homogenizer structure oscillates around a positive offset voltage determined by $(A_{RF}/A_G)^x$, where x comprises a positive number not greater than 4. The preselected plasma potential $V_{PA}$ is approximately equal to the value of the offset RF voltage when the value of the offset RF voltage is positive.

Other embodiments of the invention will be apparent to those skilled in the art after considering this specification or practicing the disclosed invention. The specification and examples above are exemplary only, with the true scope of the invention being indicated by the following claims.

I claim the following invention:

1. An RF-powered plasma accelerator/homogenizer that produces a quiescent plasma having a generally homogenous preselected plasma potential $V_{PA}$ from a primary plasma, comprising:

an RF-conductive accelerator/homogenizer structure having a total dielectric coated accelerator/homogenizer surface area $A_{RF}$ that comprises a plurality of dielectric coated accelerator/homogenizer surfaces quasi-uniformly dispersed throughout the primary plasma, an RF source reactively coupled to said RF-conductive accelerator/homogenizer structure with a coupling device, said RF source produces an RF voltage within said accelerator/homogenizer structure that causes said plurality of dielectric coated accelerator/homogenizer surfaces to absorb thermal electrons from the primary plasma; and a containment assembly coupled to said RF-conductive accelerator/homogenizer structure, said containment assembly comprises an RF-grounded structure having a total ground surface area $A_G$, wherein $A_{RF}>A_G$, said containment assembly holds the quiescent plasma at the generally homogenous preselected plasma potential $V_{PA}$.

2. An RF-powered plasma accelerator/homogenizer system that produces a quiescent plasma having a generally homogenous preselected plasma potential $V_{PA}$ from a primary plasma, comprising:

an RF-conductive accelerator/homogenizer structure having a total dielectric coated accelerator/homogenizer surface area $A_{RF}$ that comprises a plurality of dielectric coated accelerator/homogenizer surfaces quasi-uniformly dispersed throughout the primary plasma, an RF source reactively coupled to said RF-conductive accelerator/homogenizer structure with a coupling device, said RF source produces an RF voltage within said accelerator/homogenizer structure that causes said plurality of dielectric coated accelerator/homogenizer surfaces to absorb thermal electrons from the primary plasma; and a containment assembly coupled to said RF-conductive accelerator/homogenizer structure, said containment assembly comprises an RF-grounded structure having a total ground surface area $A_G$, wherein $A_{RF}>A_G$, said containment assembly holds the quiescent plasma at the generally homogenous preselected plasma potential $V_{PA}$.

3. A method to manufacture an RF-powered plasma accelerator/homogenizer that produces a quiescent plasma having a generally homogenous preselected plasma potential $V_{PA}$ from a primary plasma, comprising:

providing an RF-conductive accelerator/homogenizer structure having a total dielectric coated accelerator/homogenizer surface area $A_{RF}$ that comprises a plurality of dielectric coated accelerator/homogenizer surfaces quasi-uniformly dispersed throughout the primary plasma;

reactively coupling an RF source to said RF-conductive accelerator/homogenizer structure using a coupling device, said RF source produces an RF voltage within said accelerator/homogenizer structure that causes said plurality of dielectric coated accelerator/homogenizer surfaces to absorb thermal electrons from the primary plasma; and coupling a containment assembly to said RF-conductive accelerator/homogenizer structure, said containment assembly comprises an RF-grounded structure having a total ground surface area $A_G$, wherein $A_{RF}>A_G$, said containment assembly holds the quiescent plasma at the generally homogenous preselected plasma potential $V_{PA}$.

4. A method that produces a quiescent plasma having a generally homogenous preselected plasma potential $V_{PA}$ from a primary plasma using an RF-powered plasma accelerator/homogenizer, comprising:

quasi-uniformly dispersing a plurality of dielectric coated accelerator/homogenizer surfaces having a total surface area $A_{RF}$ throughout the primary plasma, wherein said plurality of dielectric coated accelerator/homogenizer surfaces couple together to form an RF-conductive accelerator/homogenizer structure;

producing an RF voltage within said accelerator/homogenizer structure that causes said plurality of dielectric coated accelerator/homogenizer surfaces to absorb thermal electrons from the primary plasma by reactively coupling an RF source to said RF-conductive accelerator/homogenizer structure using a coupling device; and holding the quiescent plasma at the generally homogenous preselected plasma potential $V_{PA}$ using a containment assembly coupled to said RF-conductive accelerator/homogenizer structure, said containment assembly comprises an RF-grounded structure having a total ground surface area $A_G$, wherein $A_{RF}>A_G$.

5. A dependent claim according to claim 1, 2, 3, or 4 wherein said coupling device further comprises one or more variable vacuum capacitors coupled to said RF-conductive accelerator/homogenizer structure.

6. A dependent claim according to claim 1, 2, 3, or 4 wherein said coupling device further comprises an RF tuning circuit that incorporates stray capacitance associated with a plasma liquid cooling system coupled to a pick-up electrode adjacent to a dielectric spacer, wherein said pick-up electrode and adjacent dielectric spacer have a preselected characteristic capacitance.

7. A dependent claim according to claim 1, 2, 3, or 4 wherein said coupling device further comprises an impedance-controlled circuit coupled to said RF-conductive accelerator/homogenizer structure using the stray capacitance of the primary plasma.

8. A dependent claim according to claim 1, 2, 3, or 4 wherein said coupling device comprises an RF matching network.

9. A dependent claim according to claim 1, 2, 3, or 4 wherein said RF voltage oscillates around a positive offset voltage determined by $(A_{RF}/A_G)^x$, where x comprises a positive number not greater than 4.

10. A dependent claim according to claim 9 wherein the value of said preselected plasma potential $V_{PA}$ is approximately equal to the value of said RF voltage when the value of said RF voltage offset by said positive offset voltage is positive.

11. A dependent claim according to claim 1, 2, 3, or 4 wherein said plurality of dielectric coated accelerator/homogenizer surfaces are quasi-uniformly dispersed throughout the primary plasma in a position generally parallel to the direction of ballistic electron travel.

* * * * *